US006393129B1

(12) United States Patent
Conrad et al.

(10) Patent No.: US 6,393,129 B1
(45) Date of Patent: May 21, 2002

(54) PAPER STRUCTURES FOR SPEAKER TRANSDUCERS

(75) Inventors: Terry J. Conrad, San Diego; Elwood G. Norris; James J. Croft, III, both of Poway, all of CA (US)

(73) Assignee: American Technology Corporation, San Diego, CA (US)

( * ) Notice: Subject to any disclaimer, the term of this patent is extended or adjusted under 35 U.S.C. 154(b) by 0 days.

(21) Appl. No.: 09/374,813

(22) Filed: Aug. 16, 1999

Related U.S. Application Data

(63) Continuation-in-part of application No. 09/207,314, filed on Dec. 7, 1998, and a continuation-in-part of application No. 09/159,442, filed on Sep. 24, 1998, and a continuation-in-part of application No. 09/105,380, filed on Jun. 26, 1998, and a continuation-in-part of application No. 09/004,090, filed on Jan. 7, 1998.

(51) Int. Cl.[7] ..... H04R 25/00
(52) U.S. Cl. ..... 381/191; 381/423; 381/426
(58) Field of Search ..... 381/113, 116, 381/174, 176, 399, 423, 426–428, 431, FOR 163, 191; 367/170, 181; 181/167–170, 173–174

(56) References Cited

U.S. PATENT DOCUMENTS 1,609,760 A 12/1926 Massolle
1,782,278 A 11/1930 Vogt
2,922,851 A 1/1960 Manley

*Primary Examiner*—Sinh Tran
*Assistant Examiner*—P. Dabney
(74) *Attorney, Agent, or Firm*—Thorpe North & Western, LLP

(57) ABSTRACT

An electroacoustic transducer which includes at least one stator member with an operating surface positioned adjacent to an emitter diaphragm. The stator member is comprised of at least one stiff sheet of paper having perforations for acoustic transparency. The stator also includes a means to develop electrical conductivity and to receive an applied voltage. An emitter diaphragm is suspended adjacent to and spaced a sufficient distance from the operating surface of the stator member to enable diaphragm oscillation in response to an applied signal voltage. This arrangement permits diaphragm movement within at least one emitter section without creating restrictive contact on the operating surface of the stator member. The diaphragm may be composed of paper with electrical conductivity sufficient to receive an acoustic signal voltage from a voltage source and to vibrate as an acoustic emitter with respect to forces applied at the stator member. Alternatively, the stator member may be of conventional construction, and combined with an emitter diaphragm constructed of a paper composition. Electrical contacts are also positioned on the stator member and the emitter diaphragm for coupling to appropriate voltage sources.

40 Claims, 14 Drawing Sheets

PAPER STRUCTURES FOR SPEAKER TRANSDUCERS

This application is a continuation-in-part of application Ser. No. 09/207,314 filed on Dec. 7, 1998, application Ser. No. 09/159,442 filed on Sep. 24, 1998, application Ser. No. 09/105,380 filed on Jun. 26, 1998, and application Ser. No. 09/004,090 filed on Jan. 07,1998.

TECHNICAL FIELD

The present invention relates generally to electrostatic emitters used in speaker systems. More particularly, the present invention involves the use of paper as the stator member of an electrostatic emitter.

BACKGROUND ART

Although the concept of electrostatic loudspeakers has been in development for about a hundred years, commercial applications were not realized until the late 1940's. Since then, a standard construction for electrostatic loudspeakers has dominated the state of the art. This standard utilizes two conductive, stationary, planar stators positioned such that they are in parallel, coaxial relationship with a specific displacement gap between them. A tensioned diaphragm, usually made of metalized polyester, is positioned between the stators in a non-contacting, suspended configuration. Two polarities of an AC audio signal are sent from the output of a step-up transformer to the two respective stators. A high voltage, low current DC bias voltage is concurrently applied to the diaphragm to enable vibration for an audio output.

Despite the advantages of electrostatic speakers, commercial acceptance over dynamic speaker systems has been nominal. Magnetically driven cones and related dynamic speakers have secured over 99% of the market share. This is due in part to the high cost of producing quality electrostatic systems, the space requirements for obtaining low range frequency response, and the difficulty in obtaining structures which are suited for long term stability and dependable operation. The tensioning and spacing requirements for suspending the diaphragm in noncontacting condition between stators has severely limited the speaker shape and configuration. The prior art has used relatively expensive materials for stators which supply strength and durability such as plastics, metals, woods and other strong composites. Accordingly, prior art electrostatic speakers have traditionally been expensive, flat, large in size, and generally unattractive.

U.S. Pat. No. 2,872,532 to Buchannan et al.; U.S. Pat. No. 2,935,575 to Bobb; and U.S. Pat. No. 4,439,642 to Reynard are representative of numerous prior art references which teach the basics of electrostatic speaker design. These references illustrate the conventional tensioned diaphragm suspended over a stator which includes openings or some other form of acoustic transparency. Numerous design variations have been attempted to realize other uses and arrangements for electrostatic speakers systems. For example, U.S. Pat. No. 1,782,278 teaches the use of organic matter, such as paper, combined with a conductive covering for producing an electrostatic diaphragm. Another example is U.S. Pat. No. 5,287,331 to Schindel et al, which shows the modification of a rigid stator including a roughened surface with peaks and valleys to facilitate high frequency response useful for ultrasonic emitters. U.S. Pat. No. 2,855,467 to Curry and U.S. Pat. No. 3,544,733 to Reylek et al. illustrate flexible dielectric diaphragms in combination with flexible conductive films which provide marginal audio output for specialized applications. Other advances have covered anchoring or attaching the diaphragm between along its surface area to avoid the difficulty of broad surface tensioning as discussed above. In addition, attempts have been made to develop electrostatic speaker output from layers of alternating spacer and thin film diaphragm material. These efforts have not provided the conventional stiff vibrating diaphragm necessary for low frequency response and even marginally acceptable audio output.

None of the prior art references have developed commercially acceptable solutions to providing an inexpensive electrostatic speaker which can be used in general audio applications. Nevertheless, the demand for inexpensive high quality sound systems continues to grow as electronic devices which incorporate sound systems become even more prevalent.

Accordingly, it would be an improvement over the state of the art to provide electrostatic transducers which use paper based stators. It would also be an advantage to provide paper based electrostatic emitters which are inexpensive, virtually disposable, and produce high quality acoustic output.

OBJECTS AND SUMMARY OF THE INVENTION

It is an object of the present invention to provide an inexpensive electrostatic transducer which may be used generally within the speaker industry.

It is an object of the present invention to provide paper based electrostatic emitters which are virtually disposable.

It is an additional object of the present invention to provide an electrostatic transducer wherein the stator member is an inexpensive paper material.

These and other objects are realized in an electroacoustic transducer or emitter which includes at least one stator member with an operating surface positioned adjacent an emitter diaphragm. The stator member is comprised of at least one stiff sheet of paper having perforations for acoustic transparency. The stator also includes a means to develop electrical conductivity and to receive an applied voltage. An emitter diaphragm is suspended adjacent to and spaced a sufficient distance from the operating surface of the stator member to enable diaphragm oscillation in response to an applied signal voltage. This arrangement permits diaphragm movement within at least one emitter section without creating restrictive contact on the operating surface of the stator member.

In an alternative embodiment, the diaphragm is a composition of paper having electrical conductivity sufficient to receive an acoustic signal voltage from a voltage source and to vibrate as an acoustic emitter with respect to electrostatic forces applied at the stator member. Electrical contacts are also positioned on the stator member and the emitter diaphragm for coupling to appropriate voltage sources.

These and other objects, features, advantages and alternative aspects of the present invention will become apparent to those skilled in the art from a consideration of the following detailed description taken in combination with the accompanying drawings.

DISCLOSURE OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principals of the present invention, and should not be viewed as narrowing the claims which follow.

Recently, a new electrostatic speaker has been developed which includes a non-planar and non-tensioned diaphragm. This new electrostatic speaker is described in more detail in patent application Ser. No. 09/207,314 which is entirely incorporated herein by reference. Other applications of this new electrostatic speaker are the use of piezoelectric film, planar or curved speakers, or planar magnetic speakers with a non-planar, non-tensioned diaphragm. This new speaker configuration allows electrostatic speaker sizes to be reduced by at least half, with no significant reduction in speaker fidelity or sound reproduction. In addition, it is relatively inexpensive to manufacture this new electrostatic speaker and the speaker has excellent bass output. The incorporated patent application provides extensive discussion of unique configurations for stator and diaphragm design, which will aid one skilled in the art to practice this invention. The current invention preferably uses electrostatic speakers that have paper stators combined with non-tensioned, non-planar diaphragms.

Figure 1:
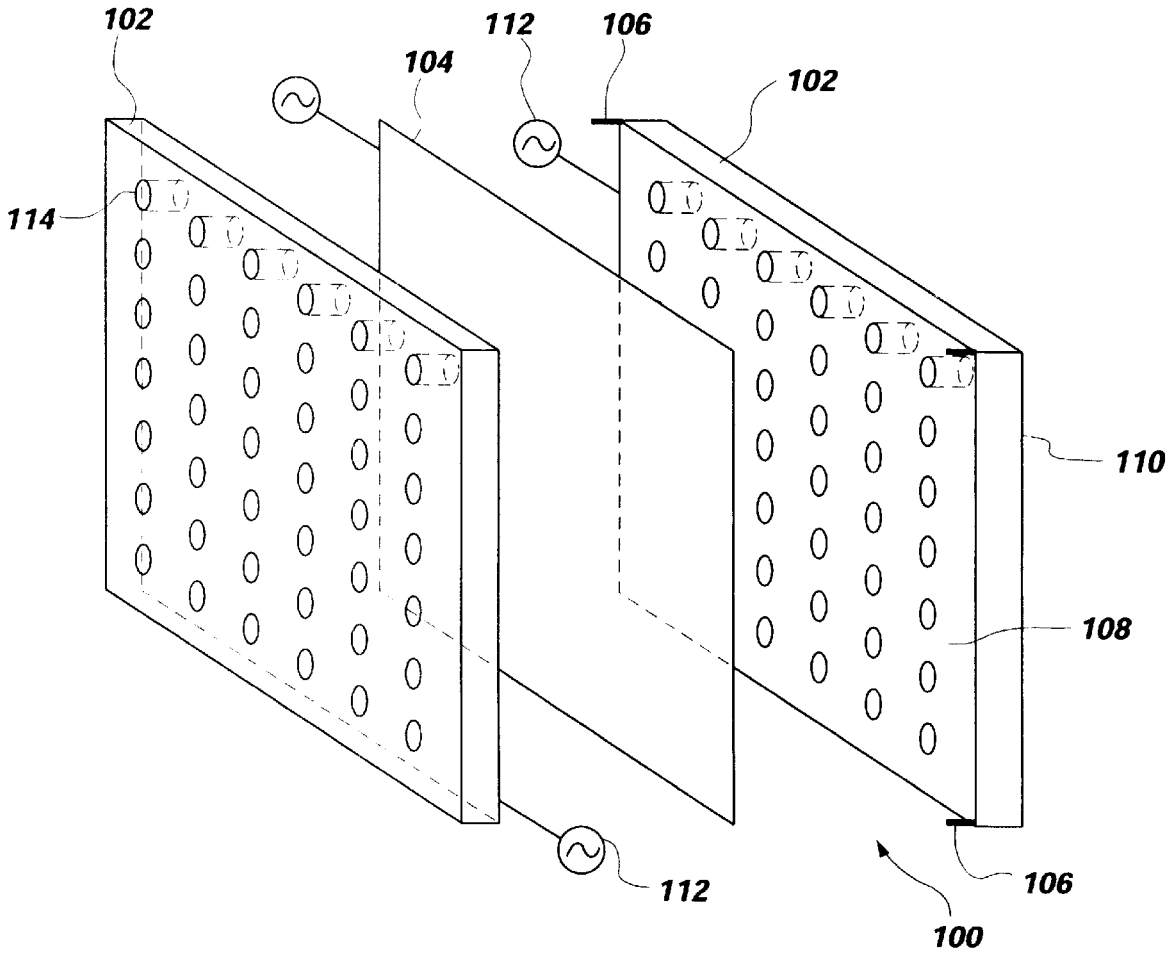
FIG. 1 shows an exploded perspective drawing of an electrostatic speaker with paper stators and a diaphragm.

It is important to note that the most significant part of this invention is the use of stators manufactured from paper type materials. As used here, the term "paper" refers to fibrous materials, such as cellulose, which are non-load bearing materials similar to writing and packaging products commonly referred to as paper and cardboard. This is to be distinguished from wood products such as particle board, Masonite and other construction materials used for walls, cupboards, shelving and other applications in which the material supports a load. Using paper and paper products in stator elements and diaphragms produces inexpensive and relatively disposable speaker emitters. FIG. 1 shows an electrostatic transducer 100 which includes at least one stator member 102, and an emitter diaphragm 104. An additional stator 102 is also used in the preferred embodiment along with spacer elements 106. The number of spacer elements used is based on the support required. The stator members 102 are comprised of at least one stiff layer of paper such as cardboard. The stator members function to provide rigid, electrically conductive support members capable of interacting electrically with the diaphragm 104 to make the diaphragm acoustically vibrate. A paper stator can be made electrically conductive by affixing metal foil, doping the stator with conductive material, or coating the paper stator with metal.

The emitter diaphragm 104 is comprised of at least one relatively thin, flexible plastic or paper sheet capable of vibrating as a speaker diaphragm. The diaphragm 104 is spaced from the stator 102 to enable vibration without contacting the stator surface and producing interference. The stator 102 has an inner operating surface 108 that is positioned adjacent to the emitter diaphragm 104 and an opposing outer surface 110. The inner operating surface 108 is preferably coated with aluminum to provide a conductive surface, but can also be comprised of other conductive materials.

An electrical contact 112 is positioned on the stator member and coupled to an alternating current (AC) voltage source. The paper stator surface which is electrically conductive is known as the stator operating surface because it attracts and repels the diaphragm. Numerous perforations 114 are bored through the stiff paper stator 102 and conductive surface to deliver maximum acoustic transparency. FIG. 1 shows the perforations as being circular in shape, but they can be of any suitable number, shape or size, such as ovals or rectangles. The perforations are generally placed in a pattern designed for maximum acoustic transparency. Various combinations of a paper stator, a diaphragm and their spatial configurations are now disclosed to demonstrate other operative embodiments of the present invention.

Before describing speaker structure embodiments constructed wholly or in part of a paper composition, it interesting to note several unexpected advantages of using paper materials for stator construction. Perhaps the most significant advantage is that using a paper composition for the stator members creates a very economical electrostatic transducer. The low cost of paper products produces a speaker which is cheap and could even be considered "disposable", much like integrated chip design has led to disposable circuit boards. The low-cost impact of such circuit boards has become a controlling feature in maintenance activity in today's electronics industry. Similarly, by using paper construction for electrostatic speaker stators, a comparable cost savings is provided for speaker components. It is foreseeable that paper electrostatic speakers would not need to be repaired when they are damaged, but simply replaced with new paper speakers. Cost effective paper speakers as described, could also be used in electronics applications where the manufacturing profit margin is already low, which would then increase the profit per item sold. Electrostatic speakers with paper elements can also be used in electronics where the life of the product is short or there is a desire to include low-cost speakers in the product. Examples of such products are electronic toys, portable stereos, electronic greeting cards, low-cost televisions or any other applications where low cost, high quality speakers are needed.

A second important feature of the present invention is the reduction in speaker weight. Conventionally, manufacturers of electrostatic transducers have employed high strength materials to create a stator that was very rigid. Typical materials used for conventional stator construction include metal, plastic, and wood products. In particular, wood based stators have used wood products which are very rigid, and include substantial load-bearing qualities suitable for use in the construction industry. For example, Masonite or plywood is typically used in wall construction, cabinetry or other construction areas which require a substantial load-bearing quality. Wood based materials which have structural strength have normally been used in electrostatic speakers and are characteristically heavy. Electrostatic speaker engineers have normally needed a strong stator to provide the necessary tension. These requirements contribute to the conventional idea that a good speaker will include substantial weight. Since the invention of the non-planar non-tensioned diaphragm, it has been discovered that it is possible to manufacture an electrostatic speaker using paper stators which produce an acceptable sound quality.

The present invention uses stiff paper for stators which does not contain the load-bearing qualities required in the construction industry nor the tension bearing qualities normally used by those manufacturing conventional electrostatic speakers. Manufacturing techniques can be applied that enable a paper speaker member to contain the particular properties needed in a stator or diaphragm. More specifically, a stator requires a certain amount of structural stiffness to support the diaphragm. In comparison, a diaphragm can use thin flexible paper because it needs a selected amount of flexibility to vibrate at audible frequencies. Those skilled in the art will recognize a clear distinction between wood-based products which are characterized as construction materials as opposed to non-construction materials, such as typing paper, notebook paper, newspaper, paper mache, posterboard, thin pressed-board, and cardboard. The widespread availability of paper, its affordability, and ease of use give paper a distinct advantage over conventional stator building materials. It should also be apparent that any suitably stiff paper products can be used for stator material in accordance with the principles of the disclosed invention.

Figure 2:
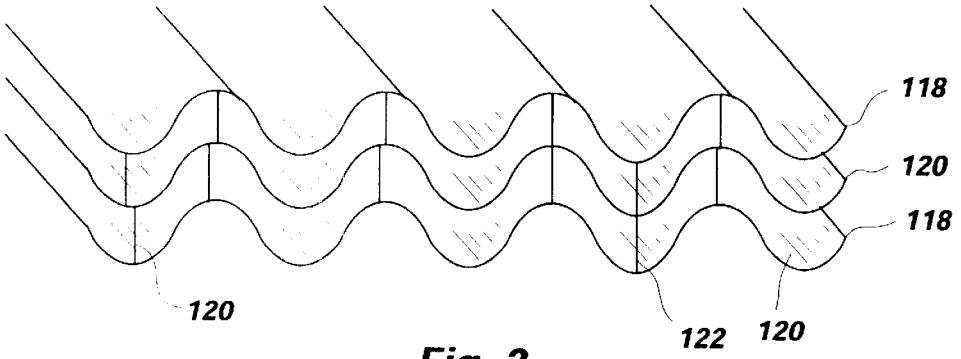
FIG. 2 shows is a side perspective view of an electrostatic speaker with corrugated paper stators and a diaphragm.

In order to produce sound frequency, an emitter diaphragm 118, shown in FIG. 2, is suspended adjacent to and spaced a sufficient distance from the operating surface 120 of the stator member 118 to enable diaphragm oscillation and movement in response to an applied audio signal voltage. The diaphragm 120 is spaced from the stators 118 by a number of vertical clamps or spacers 122. The material comprising the diaphragm 120 is a paper sheet or flexible paper product. The paper sheet will preferably have a thickness of 0.02 inches and should be a maximum of 0.125 inches or ⅛ of an inch.

Figure 3A:
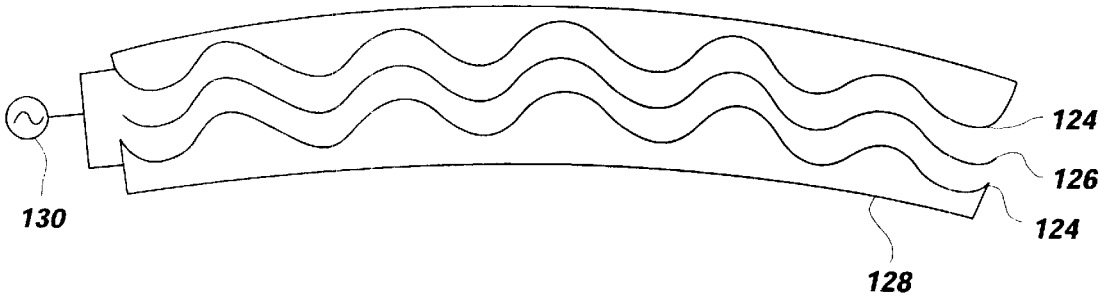
FIG. 3A shows a side view of an electrostatic speaker with corrugated paper stators supported by a flat paper backing.
Figure 3B:
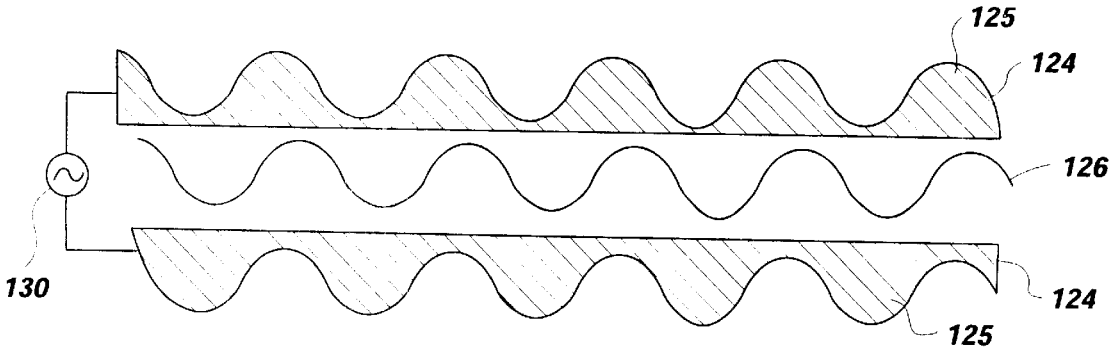
FIGS. 3B–3D show a side view of an electrostatic speaker with flat paper stators supported by a corrugated backing.

FIG. 3A shows a side view of an electrostatic speaker with corrugated paper stators supported by a flat backing. Two paper stators 124 surround a paper diaphragm 126 and are connected to a voltage source 130 to drive the metalized paper diaphragm 126. The paper stators 124 in this embodiment of the invention are attached to and supported by a flat backing 128. The corrugated stators 124 are either attached to the backing 128 with supports or formed directly out of the same paper material used for the backing. This structure provides strength similar to that found in a cardboard box. Although cardboard boxes cannot support a great deal of weight or stress, they are relatively durable. FIG. 3B shows a flat paper stator 124 with corrugated backing to give strength to the stator. The diaphragm 126 shown in FIG. 3B is also corrugated.

Figure 3C:
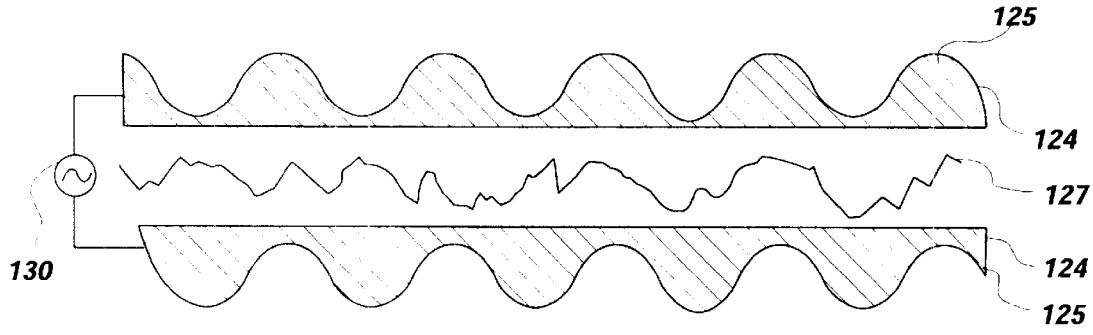
Figure 3D:
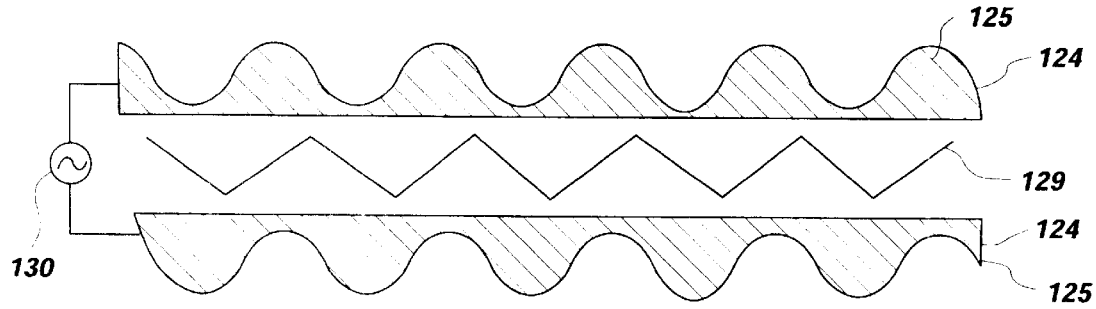

FIG. 3C is an alternative embodiment which uses a flat paper stator 124 with corrugated backing and a randomly shaped diaphragm. This diaphragm configuration is similar to paper which has been compacted and has a crinkled form with many ridges 126 and valleys 128. FIG. 3D is similar to FIG. 3C except it uses a sawtooth shaped diaphragm 129.

Figure 4:
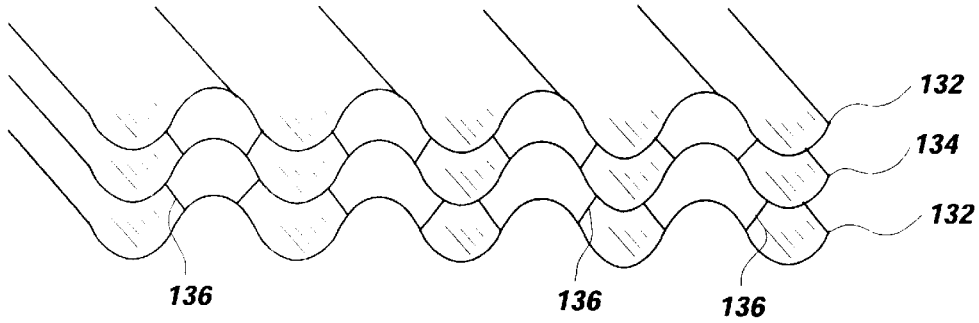
FIG. 4 shows a side perspective view of a corrugated electrostatic speaker with corrugated stators, corrugated diaphragms, and angled spacers.

FIG. 4 shows a corrugated electrostatic speaker similar to that of FIG. 3A with two corrugated paper stators 132 and a corrugated diaphragm 134. A number of angled spacers 136 are included to separate the diaphragm from the stators to avoid touching the stators which could cause audio distortion. Although FIGS. 1–4 have been described as being made with paper stators and diaphragms, it is possible for only one element such as the stator to be made of paper and the diaphragm could be made of metalized plastic. The reverse is also true, where the stator could be metal or metal coated plastic and the diaphragm could be paper. Further, the stators are. configured to provide uniform charge dispersion and a rigid support through the spacers and clamps used.

Figure 5:
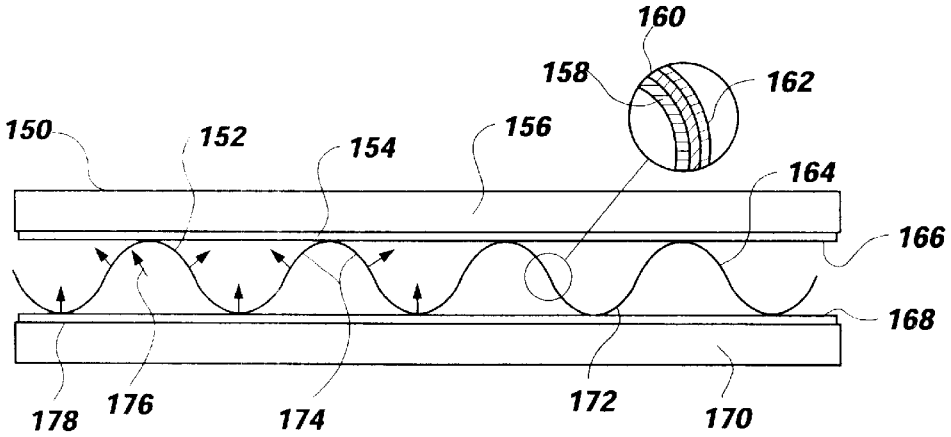
FIG. 5 shows a side view of an electrostatic speaker with a cushion member between the diaphragm and the stators.
Figure 8:
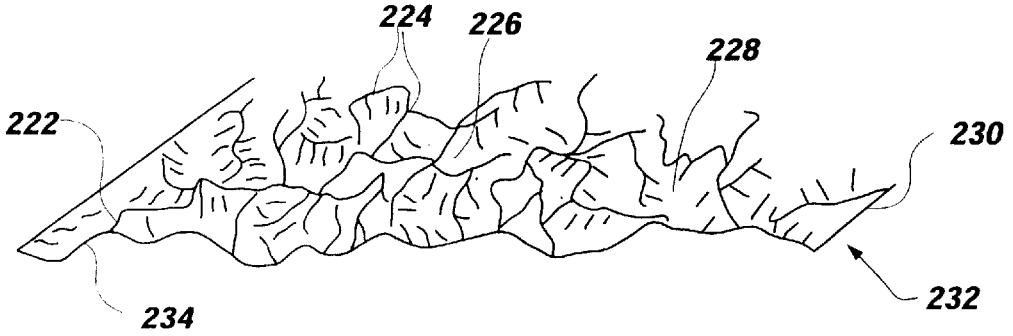
FIG. 8 is a perspective view of a diaphragm depicting a crinkled arrangement.

Referring now to FIG. 5, a corrugated diaphragm is shown mounted between paper stators 170 and 150. This invention contains a paper diaphragm with a geometric configuration characterized by a continuous array of peaks 152 and valleys 172, as viewed from each respective side of the diaphragm. In other words, when viewing the diaphragm from the top side one sees alternating peaks 152 and valleys 170 which define the operating surface of the diaphragm relative to the interior surface 166 of the first stator 150. Peaks and valleys are a general reference to non-planar diaphragm construction where opposing sides of the diaphragm form multiple contact points (peaks) with respective interior surface areas of the stators, separated from adjacent contact points by non-contacting regions (valleys) of the diaphragm displaced from the interior surface areas. In the paper diaphragm, the array of peaks and valleys does not need to occur in a particular pattern. Indeed, FIG. 8 illustrates a totally random array of peaks and valleys resulting from a diaphragm membrane which has been crumpled into a compressed shape, and then released to impart crinkled ridges as the contact points or peaks. Therefore, any pattern in flexible, non-planar paper may provide the desired properties of peaks and valleys for the invention.

Another important feature of a non-planar paper diaphragm is that the peaks of each side of the diaphragm are positioned adjacent to the interior surfaces of the stators, but are substantially unattached. This is in contrast to prior art diaphragms of planar form which are anchored at points along the diaphragm in strip-like configurations. Whereas prior art emitters were somewhat segmented for vibration along each strip length, the present invention involves a diaphragm which is not attached or so anchored. Of course, some attachment may be necessary, such as around the diaphragm perimeter to position it the between the stators. However, the diaphragm is generally unattached to provide some freedom of movement.

FIG. 5 illustrates a diaphragm 164 with a generally sinusoidal configuration. This shape has a broadband response which generates a surprisingly high quality electrostatic speaker. The sinusoidal curvature may be applied by numerous methods to conventional paper or metalized paper. The paper may readily be molded or otherwise preformed, as long as the paper retains the corrugated shape. This diaphragm is positioned between two opposing metal coated paper stators, and cushioned with a thin layer of paper insulation 204. The paper insulation layer provides a soft landing for the peaks 152 as they are pushed and pulled toward the interior surfaces of the stators. Because of the nearness of the oppositely charged surfaces 154 and 178, this region has the highest capacitance and greatest attraction. Accordingly, the use of the cushion prevents slapping of the diaphragm against the otherwise rigid paper stator, particularly at lower frequencies. The cushion may be continuous across the interior surface of the stators, or it may be segmented. In addition, the paper cushion layer may even be conductive where the diaphragm includes a nonconductive contacting side juxtaposed to the conductive cushion layer.

FIG. 5 also illustrates an embodiment of the diaphragm in which the metalized paper layer 160 is insulated on each side by opposing layers of conventional paper. Specifically, the movable diaphragm 164 comprises opposing first and second nonconductive layers 158 and 162 applied to opposing first and second sides of the conductive layer 160. The peaks 152 of the first layer 162 of the diaphragm are disposed for contact at the interior surface 166 of the first stator 156 in response to changing charge distribution on the first and second stators. Similarly, the peaks 172 of the second side of the diaphragm are disposed in an alternating manner with respect to the peaks 152 of the first side for contact at the interior surface 168 of the second stator in response to the changing charge distribution on the first and second stators. With opposing insulated surfaces of this diaphragm, it should be noted that the paper insulation layer 178 may be either conductive or nonconductive paper material. This insulation layer may be selected from numerous paper composites which provide a soft, resilient landing surface for the diaphragm, such as paper combined with polyester, cotton, nylon, and conductive forms of these materials. Generally, the insulation layer has a thickness of less than 2 millimeters. However, greater thicknesses may be applied for specific effects. The conductivity of the paper diaphragm can also be a layered material such as a paper sheet attached to a doped paper layer, metal foil affixed to one side of the paper sheet, or metal foil sandwiched inside two paper sheets. A double sided paper-metalized paper-paper sheet may be used to avoid arcing between the diaphragm and stators. Other paper compositions for emitter films could be constructed based on this disclosure.

Figure 6:
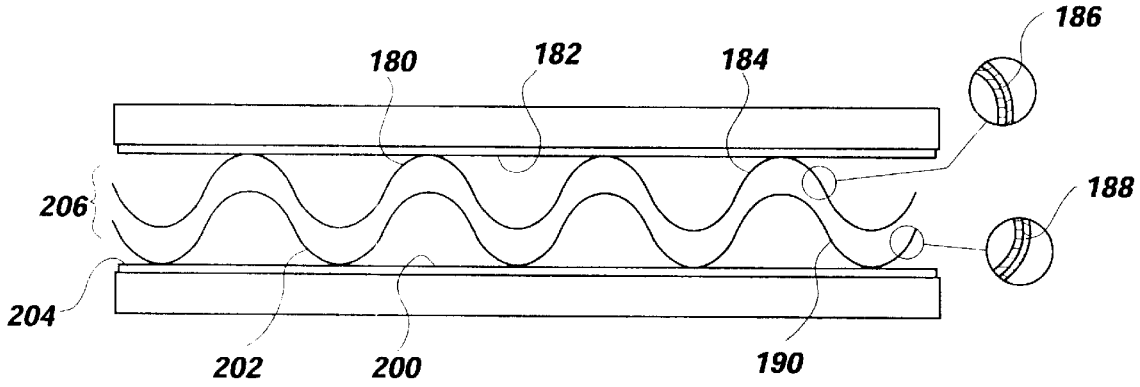
FIG. 6 is an electrostatic speaker configuration using paper stators and a double diaphragm.

FIG. 6 shows an electrostatic transducer wherein the movable diaphragm 206 comprises at least two conductive layers of paper 184 and 190 having respective first and second nonconductive layers 186 and 188 applied to opposing first and second sides which are most adjacent to the interior surfaces 182 and 200 of the respective first and second paper stators. The peaks 180 of the first nonconductive layer of the diaphragm are disposed for contact at the interior surface 182 of the first stator in response to changing charge distribution on the first and second paper stators, and the peaks 202 of the second nonconductive side of the diaphragm are disposed in alternating manner with respect to the peaks of the first side for contact at the interior surface 200 of the second stator in response to the changing charge distribution on the first and second stators. Here again, the respective first and second paper stators include some form of openings (not shown) positioned adjacent the respective alternating valleys of the first and second sides of the diaphragm to allow sound to pass through the stator to a surrounding environment. The respective interior surfaces of the first and second stators have been modified with the thin cushioning layer 204 of material to provide a soft landing area for the peaks of the diaphragm.

Figure 7:
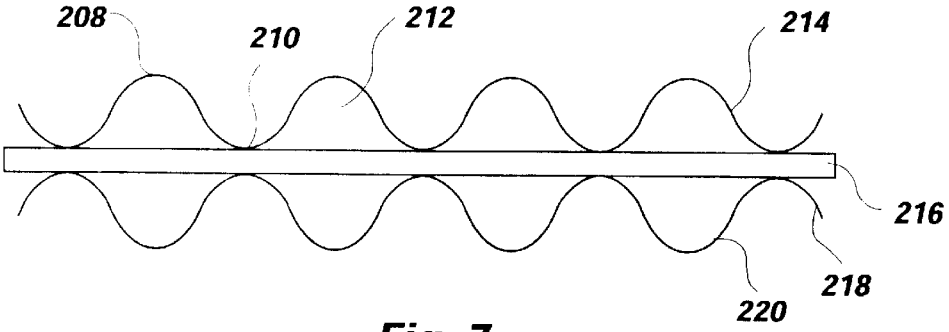
FIG. 7 shows a cross section of a single stator with opposing diaphragms on both sides of the stator.

FIG. 7 illustrates an inverted configuration, wherein a single paper stator 216 supports opposing paper diaphragms 214 and 220. A housing or enclosure (not shown) provides a cushioned containment of the peaks 208 which are remote from the stator. Other paper stator and diaphragm configurations will be apparent to those skilled in the art, including modified sine waves, rectified sine waves, saw tooth configurations, etc.

Figure 9:
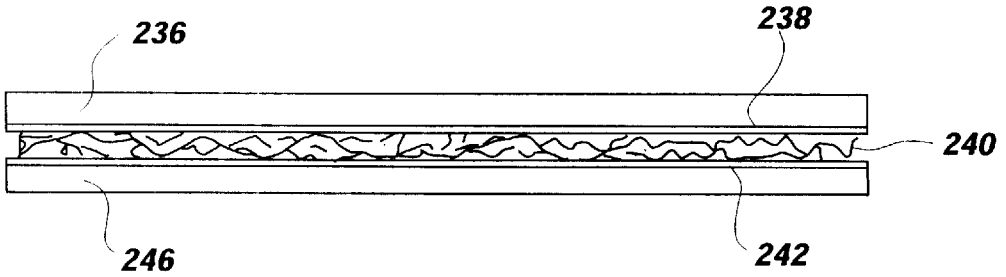
FIG. 9 is a side view of the diaphragm of FIG. 8 disposed between two paper stators.

FIGS. 8 and 9 show a random version of peaks and valleys, wherein a sheet of paper 232 or metalized film has been compressed into a ball to cause a wrinkling effect on the structure. Upon release, the paper expands, but retains the wrinkles in the form of peaks 224 and separating valleys 226. In FIG. 9, this crinkled sheet has been disposed between paper stators 236 and 246 and a cushion layer 238 is applied at the interior surfaces of the respective stators. This randomized configuration is an effective form of an electrostatic speaker with excellent fidelity.

Figure 10:
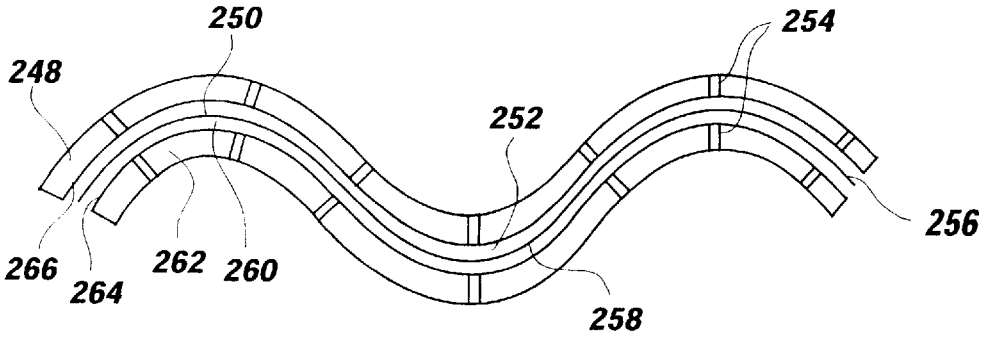
FIG. 10 depicts a sinusoidal paper stator configuration matching a sinusoidal diaphragm.

An additional geometric embodiment of the electrostatic transducer is shown in FIG. 10, wherein the interior surfaces 266 and 264 of the first and second paper stators 248 and 262 are geometrically configured to generally conform to the desired geometric configuration of the peaks 250 and valleys 260 of the diaphragm 256. This enables close positioning of the respective interior surfaces of the first and second stators adjacent to the diaphragm. Openings 254 are provided in the paper stators to facilitate acoustic transparency. It will be apparent to those skilled in the art that other geometries can be envisioned which place the stators in close position to the diaphragm to increase the effects of the electrostatic fields.

Figure 12:
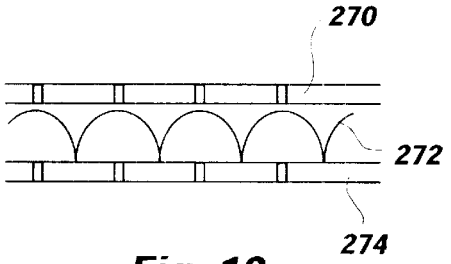
FIGS. 12 and 13 show other diaphragm configurations including a rectified sine wave and sawtooth shape.
Figure 13:
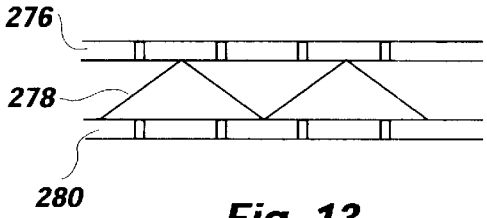
Figure 11:
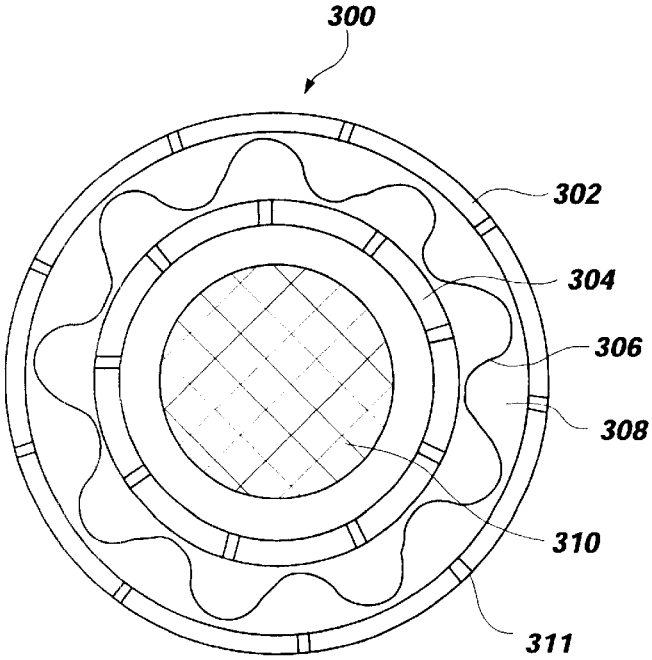
FIG. 11 depicts concentric cylinder stators and diaphragm as an electrostatic transducer.

FIG. 11 depicts a cross section of an electrostatic transducer 300 wherein the respective first and second paper stators 302 and 304 are configured respectively as cylinders with concentric, enclosing geometries to provide an audio speaker having a substantially full surround emitting surface. The diaphragm 306 is suspended within the annular opening 308, being stabilized between the opposing interior surfaces of the stators. Sound is emitted circumferentially, as well vertically from a central resonant chamber 310. Openings 311 provide acoustic transparency along both radial orientations of propagation. The diaphragm is illustrated in a preferred form of general sinusoidal shape. However, other diaphragm configurations such as the rectified sinusoidal shape of FIG. 12 and the modified sawtooth form of FIG. 13 may be used.

Figure 14A:
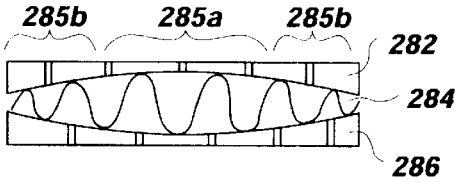
FIGS. 14A and 14B show stator/diaphragm combinations having diaphragms configured for selected resonance bandwidths.
Figure 14B:
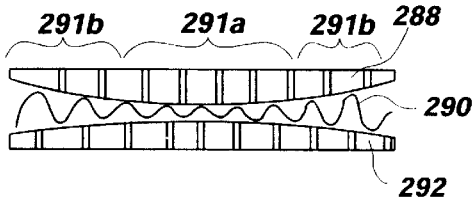

FIGS. 14A and 14B show variations in the diaphragm useful for developing different resonant responses within the electrostatic emitter. For example, FIG. 14A shows paper stators 282 and 286 having opposing concave interior surfaces. A sinusoidal diaphragm 284 is disposed between the concave surfaces with increasing peak heights in near contact with the stators. The larger wave forms 285A favor lower resonant frequencies, while the shorter peaks 285B operate at the higher resonant frequencies. Conversely, the embodiment of FIG. 14B depicts opposing convex stators 282 and 292, with an intermediate diaphragm 290 having a central section 291A favoring higher frequencies, and lateral sections 291B configured for lower frequencies. These embodiments generally represent the configuring of the diaphragm for different resonant frequencies based on wave form height and shape.

Figure 15:
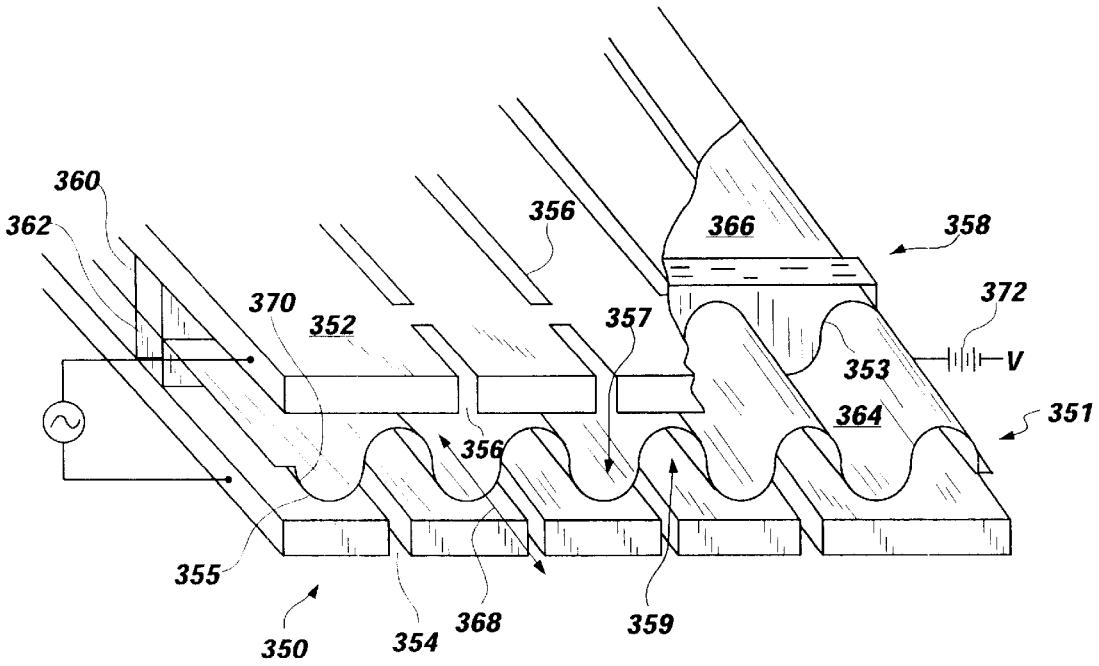
FIG. 15 is a partially cut-away perspective view of an electrostatic speaker with a sinusoidal diaphragm disposed between and spaced from the opposing stators by a clamp member.

Now, a more detailed discussion regarding diaphragm clamping will be covered. Referring to FIG. 15, an electrostatic emitter is shown having a substantially sinusoidally shaped diaphragm 351 spaced between and apart from a pair of opposing paper stators 350 and 352. Slots or openings 354 and 356 in stators 350 and 352 are disposed adjacent to a valley or trough of the diaphragm to provide audio energy outlets and acoustic transparency for the audio output of the system.

The alternating peaks 355 and valleys 357 extending along the longitudinal dimension of the paper diaphragm, provide an increased stiffness in the longitudinal direction 368 of the diaphragm. This stiffness enables the diaphragm to oscillate sufficiently to provide acoustical tones without having any tension applied to the longitudinal dimension. This stiffness is referred to herein as an "increased stiffness orientation" corresponding to the directional stiffness of the channels 23 or other stiffening means.

A clamp 358 is disposed at an intermediate position along the stiffened longitudinal dimension of the diaphragm. Clamp 358 comprises opposing clamp members 360 and 362 extending substantially transverse across the diaphragm 352. Clamp 358 is composed of any rigid material to isolate separate emitter sections 364 and 366 in the diaphragm 351 for providing desired frequencies. As shown in the cutaway portion of FIG. 15, clamp member 360 has an inner surface 353 which substantially conforms to the sinusoidal shape of diaphragm 351. A similar sinusoidal clamp configuration may be seen in FIG. 16 from an orthogonal view. Although the stators of the present invention are paper based, it is important that they are constructed to provide uniform charge dispersion and stiff support. Stators which provide these qualities will normally have a metal coating or metal foil glued to the stator and be made of a stiff cardstock paper or some equivalent. Preferably the diaphragm is pre-molded in its sinusoidal shape and is flexible so as to resume its shape after temporary deformation.

Figure 16:
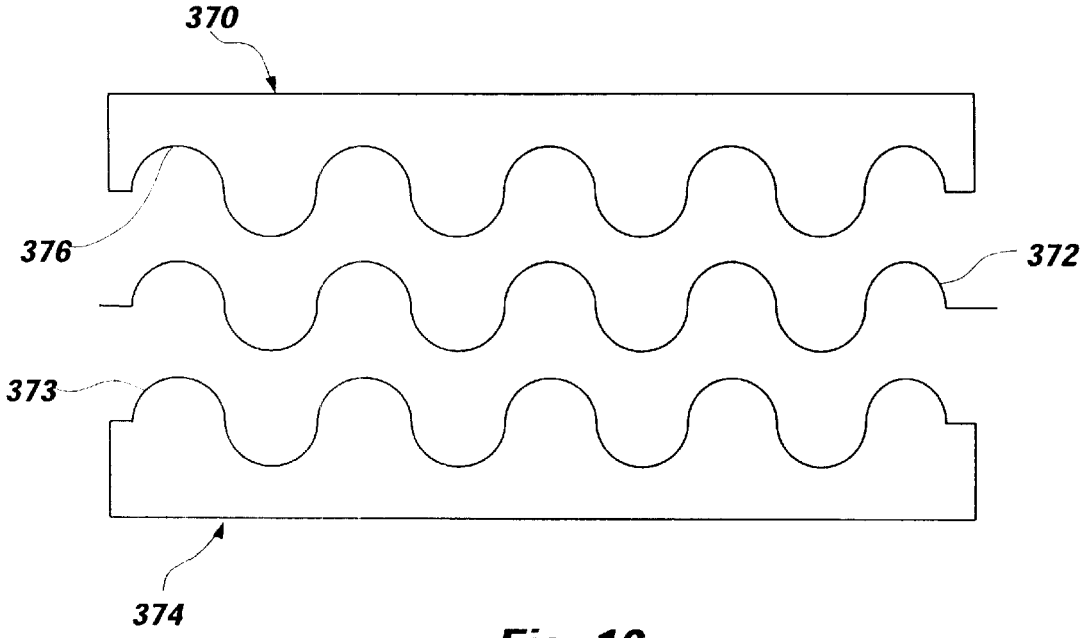
FIG. 16. shows a pair of clamp members to secure a non-planar diaphragm and having inner surfaces conforming to the shape of the non-planar diaphragm.
Figure 17:
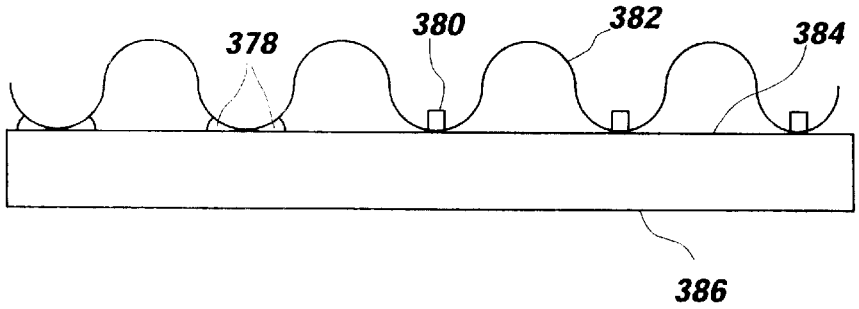
FIG. 17 shows a single clamp member in contact with a non-planar diaphragm.
Figure 18:
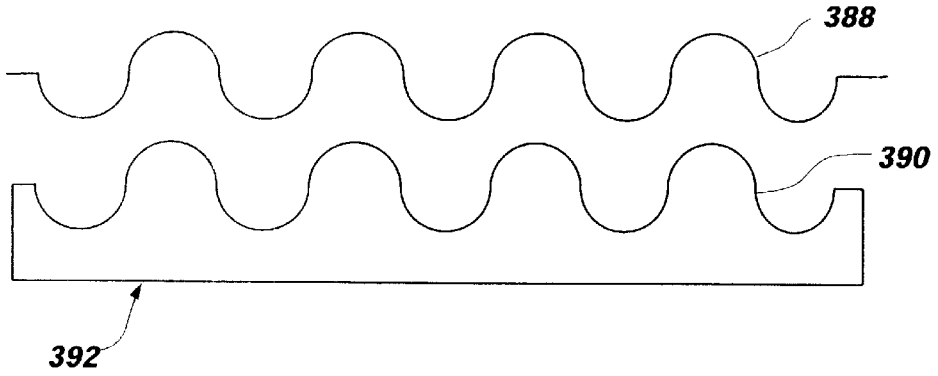
FIG. 18 shows a single clamp member arranged to secure a non-planar diaphragm where the clamp's inner surface conforms to the shape of the diaphragm.

Referring now to FIGS. 17 through 22, various forms of clamping members for securing the diaphragm are shown, in accordance with alternative embodiments of the invention. In FIG. 17, a paper clamping member 386 extends adjacent to a flexible non-planar diaphragm 382 so that its inner surface 384 is touching or is bonded to the peaks of the diaphragm. Suitable coupling means, such as an adhesive 378 or a clip 380 are applied to secure the diaphragm 382 to the clamping member 386. As shown in FIG. 16, the inner surfaces 373 and 376 of clamp members 374 and 370 may be configured into a sinusoidal or other shape which conforms to the shape of the diaphragm 372 to firmly clamp down on the diaphragm 372 and achieve substantial isolation of the emitter section (not shown) without crushing the non-planar shape of the diaphragm 372. This clamp configuration is essentially the same as shown in FIG. 15. Likewise, in FIG. 18, a single clamp member 392 also has an inner surface 390 shaped to conform to the shape of the diaphragm 388 which is secured to clamp member 392 by an adhesive or other conventional means.

Figure 19:
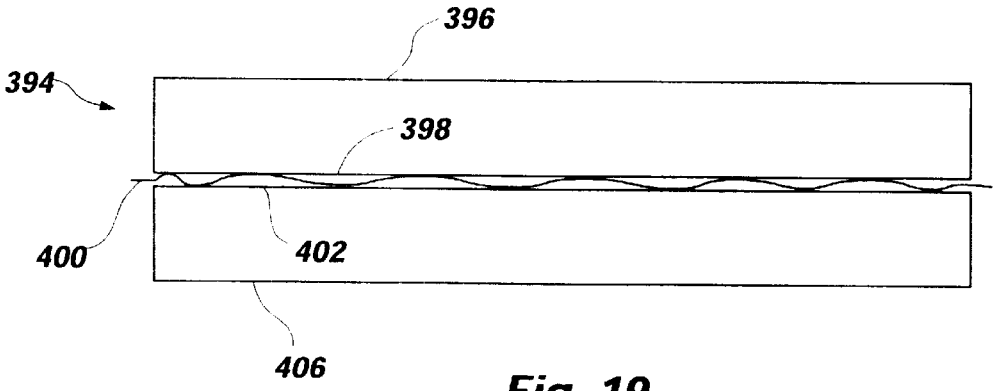
FIG. 19 shows a substantially flat section of a generally non-planar diaphragm secured between the inner surfaces of a pair of clamp members.
Figure 20:
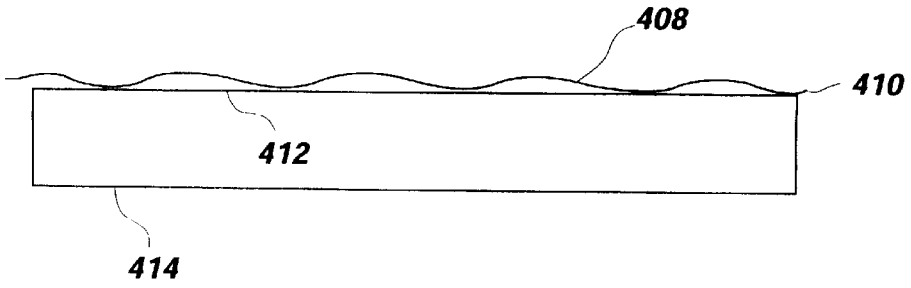
FIG. 20 shows a substantially flat non-planar diaphragm secured to the inner surface of a single clamp member.

As shown in FIG. 19, a paper clamp 394 comprising opposing clamp members 406 and 396 has opposing inner planar surfaces 402 and 398 which are clamped down tightly against a non-planar diaphragm 400 crushing the diaphragm shape substantially flat between surfaces 402 and 398. Preferably such shape crushing only occurs in the immediate vicinity of the clamp members 406 and 396, and the diaphragm 400 maintains its non-planar shape and stiffness orientation in the emitter sections on either side of the clamp members. Although the embodiment shown in FIG. 20 is less effective, a single clamp member 414 having a planar surface 412 may have a non-planar diaphragm 408 crushed substantially flat adjacent to surface 412 and secured thereto by conventional means, such as adhesive. Diaphragm 408 is preferably heat formed so as to resume its non-planar shape when the clamping pressure is removed.

Figure 21:
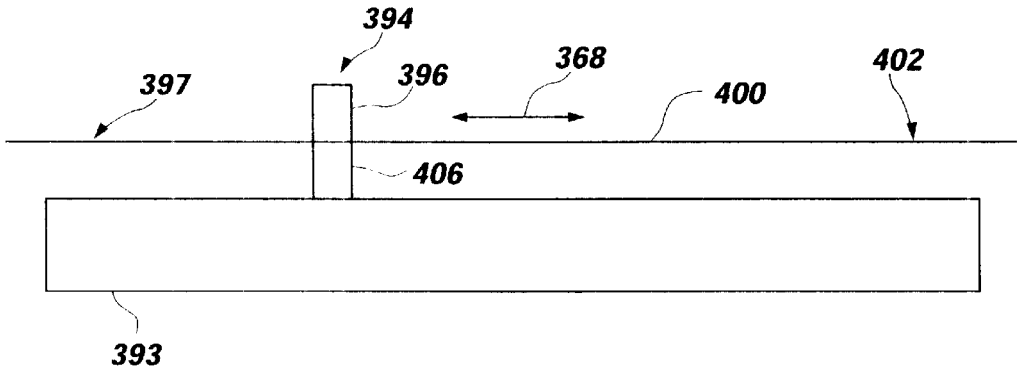
FIG. 21 shows a clamp member supporting a diaphragm above the inner surface of a stator member.
Figure 22:
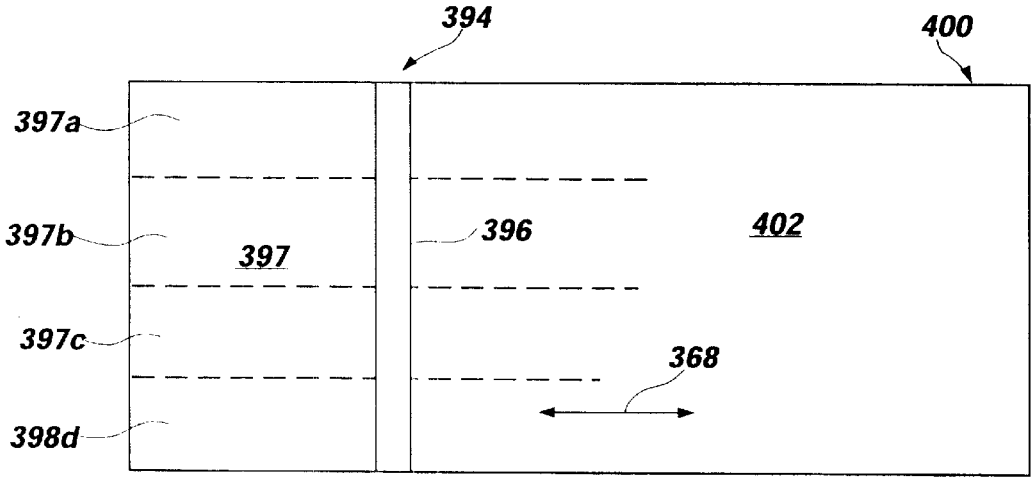
FIG. 22 shows a top plan view of FIG. 21 where a clamp member extends transversely across the diaphragm at an intermediate diaphragm position.

FIGS. 21 and 22 provide side and top views, respectively, of the embodiment shown in FIG. 19, wherein a paper clamp 394, consists of a pair of clamp members 406 and 396, and is secured to the diaphragm 400. As shown, clamp 394 is disposed on a stator 393 at an intermediate position along the longitudinal direction of stiffness 368 of diaphragm 400 and extends transverse to the direction of stiffness. This intermediate position of clamp 394 divides the diaphragm 400 into two emitter sections 397 and 402, which are isolated from each other. Each section has its own resonant frequency or frequencies, which are dependent on the shape and area of that section. Sections 397*a–d* could alternatively be made of alternating compositions of paper for reduced flexibility and stiffness enhancement.

The above arrangement of the paper clamp 394 has at least two important effects. First, clamp 394 defines two distinct and isolated emitter sections and thereby minimizes stray and undesirable vibrations and oscillations which cause distortion. Second, clamp 394 establishes different-sized emitter sections, each supporting a different set of resonant frequencies. It should also noted be that the clamp shown could be situated at an angle with respect to the stator. Furthermore, multiple clamps could be used along the diaphragm to create multiple sizes and shapes in the diaphragm.

Figure 23:
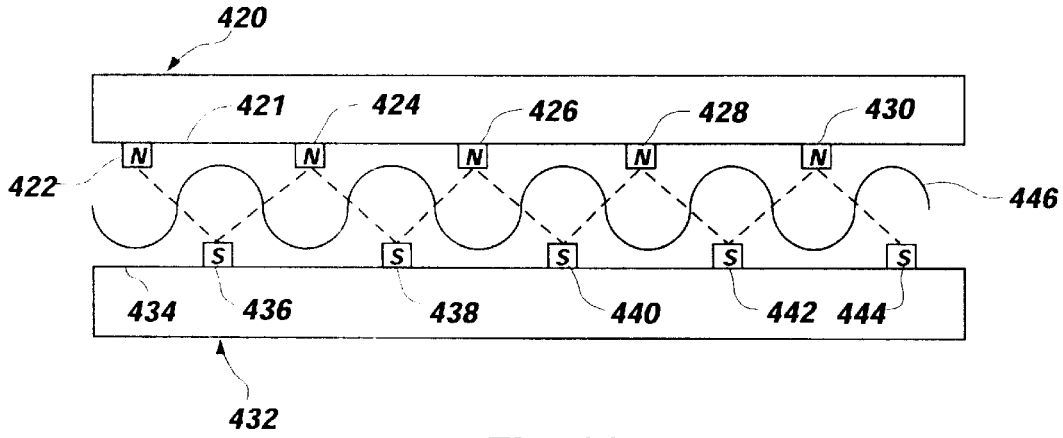
FIG. 23 is an electroacoustic transducer wherein magnets are employed for driving the diaphragm using cross-magnet polarity fields.
Figure 24:
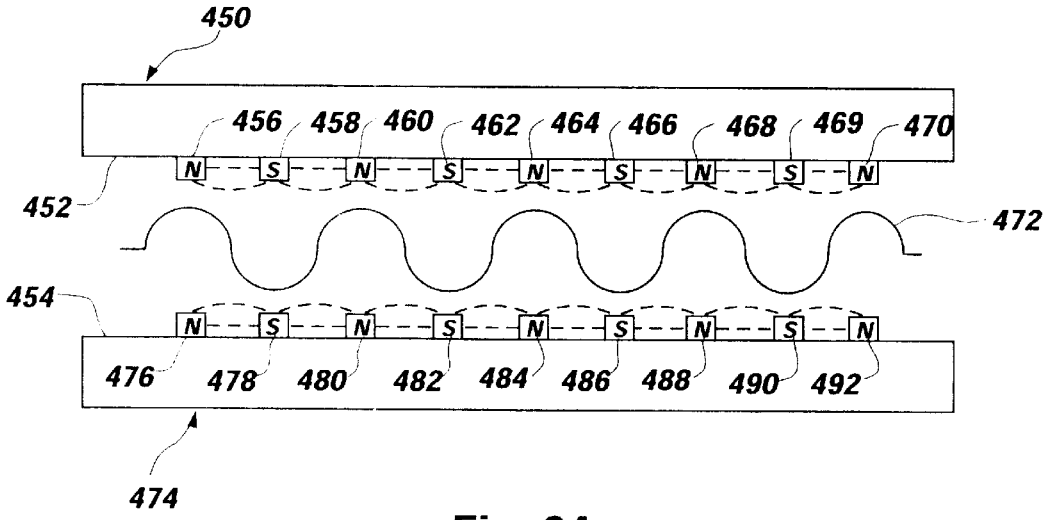
FIG. 24 is an electroacoustic transducer wherein magnets are employed for driving the diaphragm using planar magnetic fields.

The speaker may have an electrostatic drive, as shown in FIG. 1, or it may be driven magnetically, as shown in FIGS. 23 and 24 described below. FIG. 23 shows a first magnetic embodiment, in which upper magnetic strips 422, 424, 426, 428 and 430 are attached to the inner surface 421 of a paper upper support member 420 and are magnetically oriented as north poles. Paper support members 420 and 432 only provide support and do not act as stators to drive the diaphragm 446. Rather, the acoustic drive signal is introduced across the magnetic strip elements, and the magnetic strips are employed as a magnetic drive.

Lower magnetic strips 436, 438, 440, 442, 444 are attached to the inner surface 434 of a lower support member 432 and are magnetically oriented as south poles. The lower magnetic strips are offset relative to the upper magnetic strips, so that the magnetic fields cut across at angles, as shown between the upper and lower poles at the angles shown by the dotted lines. This action tends to drive the diaphragm 446 at a 90 degree angle from the field lines. Because of the non-planar configuration of the diaphragm 446, it bends in the direction of the magnetic force to provide an acoustical response without significant distortion.

Referring now to FIG. 24, an alternate magnetic embodiment of the present invention is shown in which a diaphragm 472 is suspended by one or more securing members (not shown) between opposing support members 450 and 474. Multiple magnetic strips 456–470 are attached to the inner surface 452 of the upper support member 450 and are longitudinally spaced across the cross-section of the upper support member 450. Likewise, multiple magnetic strips 476–492 are attached to the inner surface 454 of the lower member 474 and are longitudinally spaced across the cross-section of lower support member 474. The upper magnetic strips 456–470 are disposed directly across from the corresponding lower magnetic strips 476–492.

Figure 25:
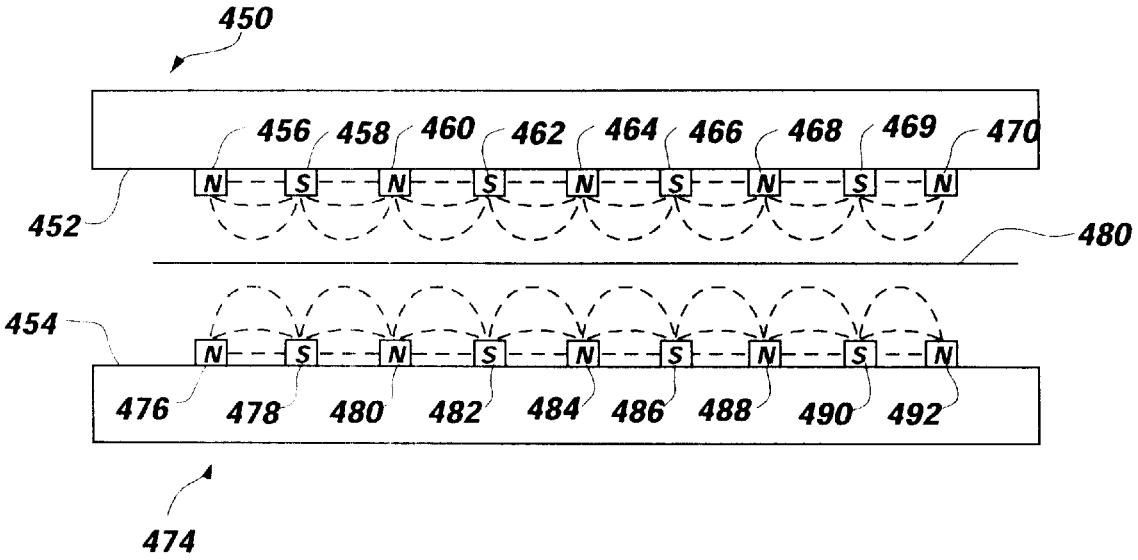
FIG. 25 is an electroacoustic transducer wherein magnets are employed for driving the planar diaphragm.

The upper magnetic strips 456–470 are alternately magnetized as north, south, north, south and north, respectively. Likewise, the opposing magnetic strips 476–492 have the same magnetic orientation of north, south, north, south and north, respectively. Consequently, the lines of the magnetic field flow in a planar fashion above and below the diaphragm 472, as shown. Since the lines of force compel movement of the diaphragm at 90 degrees to the field lines, the diaphragm 472 is driven in vertical oscillations, as desired. FIG. 25 shows an alternate embodiment the magnetic transducer of FIG. 24 with a planar diaphragm 480. Additional lines of magnetic force are shown in FIG. 25 which would also exist in FIG. 24.

Figure 26:
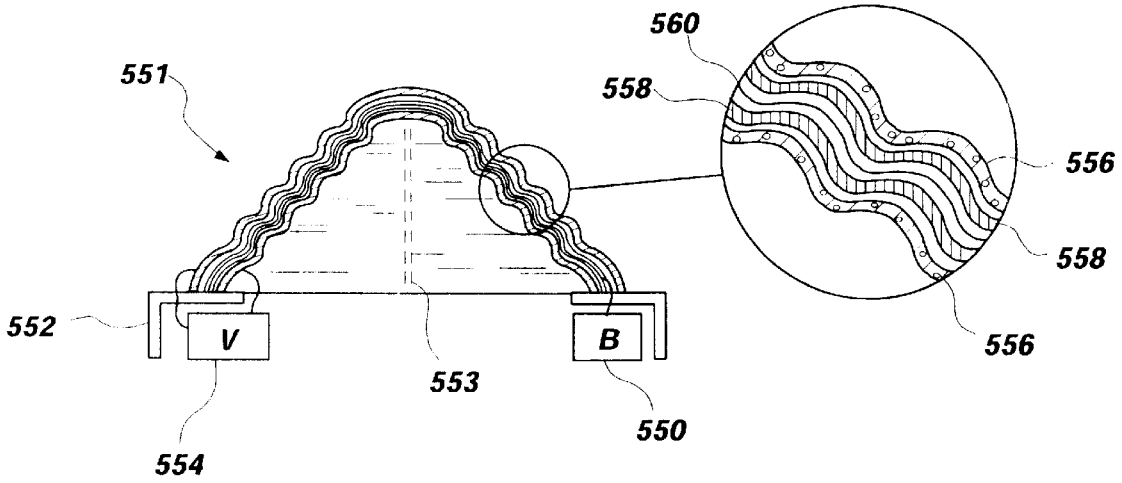
FIG. 26 is a cross-sectional side view of a hemispherical electrostatic speaker.

Another embodiment of a paper electrostatic transducer is shown in FIG. 26. A cross section view of a hemispherical electrostatic transducer 551 is shown anchored to a base 552. FIG. 26 is a cross section of the FIG. 27 along arrow 570. Two cylindrical corrugated stators 556 create a hemispherical shape and a non-planar diaphragm 560 is arranged between the two opposing paper stators. In addition, a supporting structure 553 (e.g. made of paper) runs along an inside surface of the hemisphere or along a longitudinal axis of the hemisphere. It should be realized that the stators have holes or apertures, so they are acoustically transparent and allow ultrasonic waves to pass through the stator. The diaphragm is biased by a bias voltage 550 and the audio signal 554 is applied to produce an ultrasonic compression wave. A cushioning or insulating layer 558 is contained within the stators so the diaphragm will not directly contact the conductive layer on the stators and avoids other distorting contact with the stator.

Figure 27:
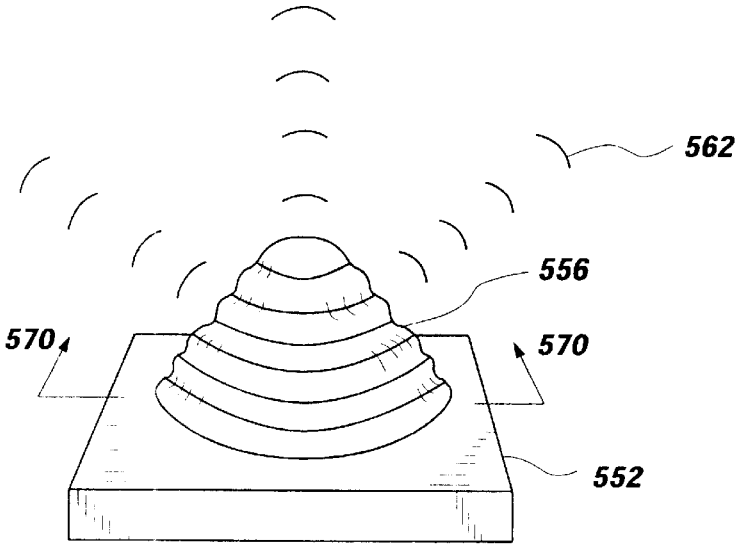
FIG. 27 is a perspective view of a hemispherical electrostatic speaker.
Figure 28:
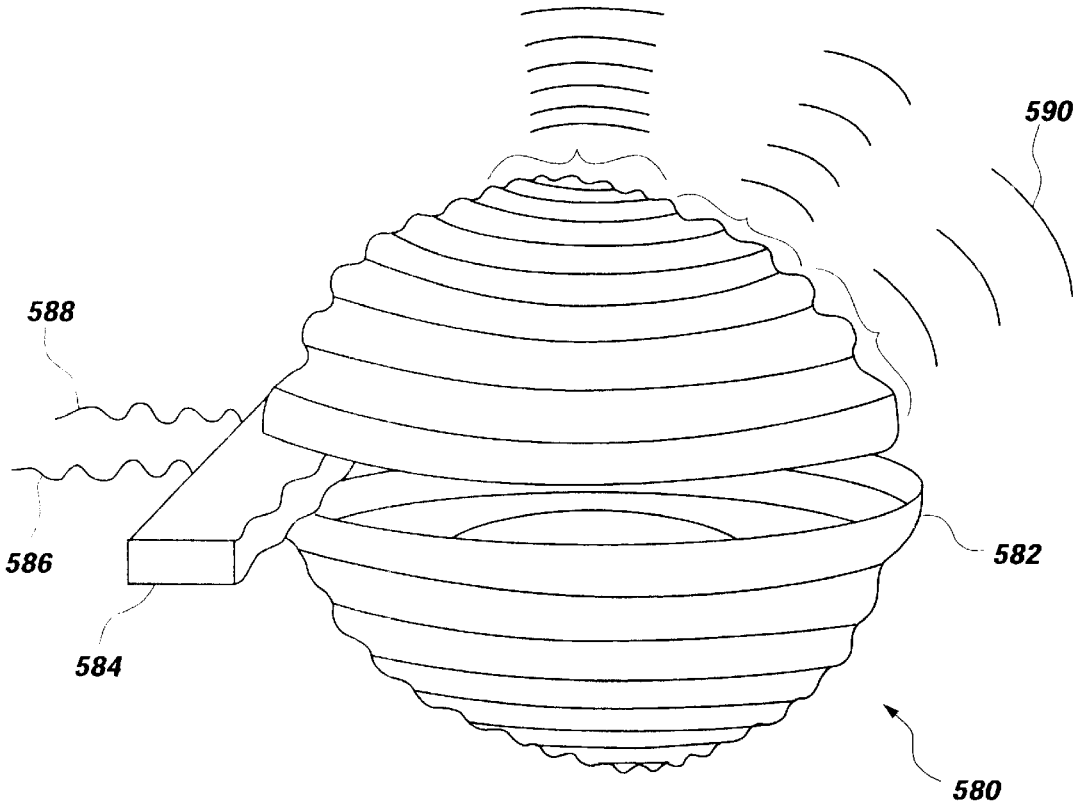
FIG. 28 is a perspective side view of a spherical electrostatic speaker.

FIG. 27 is a perspective view of a hemispherical electrostatic speaker. Because of the hemispherical nature of this embodiment, the sound that emanates through the stators 556 radiates in 180 degrees in multiple axes. A full sphere embodiment of the present embodiment is shown in FIG. 28. This figure shows a partially exploded view of the spherical embodiment 580 which is a combination of two hemispheres as shown in FIG. 31. This spherical arrangement allows the ultrasonic sound waves 590 to pass through the stators 582 in all possible directions. An electrical assembly 584 (shown cut away) can be the base for each of the hemispheres. The electrical assembly can also be sized small enough to be contained within the hemispheres. A bias is applied to the diaphragms contained within the hemispheres through the input 588 and the audio signal is then applied through 586.

It is to be understood that the above-described arrangements are only illustrative of the application of the concepts of the present invention. Numerous modifications and alternative arrangements may be devised by those skilled in the art without departing from the spirit and scope of the present invention. The appended claims are intended to cover such modifications and arrangements.

What is claimed is:

1. An electroacoustic transducer, including:

at least one stator member having an operating surface for positioning adjacent an emitter diaphragm, said at least one stator member being comprised of at least one stiff layer of paper having perforations for acoustic transparency and including means for developing electrical conductivity to receive an applied voltage;

an emitter diaphragm suspended adjacent to and spaced a sufficient distance from the operating surface of the stator member to enable diaphragm oscillation in response to an applied signal voltage to permit diaphragm movement within at least one emitter section without incurring interfering contact with the operating surface of the stator member;

electrical contacts positioned on the stator member for coupling to a voltage source; and electrical biasing applied to the emitter diaphragm.

2. A transducer in accordance with claim 1, wherein the stator member comprises a sheet of paper having a thickness of less than approximately ⅛ of an inch.

3. A transducer in accordance with claim 1, wherein the stator member comprises a sheet of paper having a thickness of 0.02 inches.

4. A transducer in accordance with claim 1, wherein the stator member comprises a sheet of cardboard having a corrugated member and at least one planar side bonded to the corrugated member to provide sufficient stiffness to operate as a stator with respect to the emitter diaphragm, said planar side comprising the operating surface of the stator.

5. A transducer in accordance with claim 1, wherein the stator member comprises a sheet of cardboard having a corrugated member and at least one planar side bonded to the corrugated member to provide sufficient stiffness to operate as a stator with respect to the emitter diaphragm, said corrugated member comprising the operating surface of the stator.

6. A transducer as defined in claim 1, wherein the means for providing conductivity includes conductive doping material in the sheet of paper.

7. A transducer as defined in claim 1, wherein the means for providing conductivity includes conductive material disposed on a surface of the stator member, said conductive material being acoustically transparent to sound waves generated by the emitter diaphragm.

8. A transducer as defined in claim 7, wherein the conductive material comprises a layer of metal positioned on the operating surface of the stator member.

9. A transducer as defined in claim 1, wherein the stator member further is a corrugated stator formed from a sheet of stiff paper to provide sufficient stiffness to operate as a stator with respect to a corrugated emitter diaphragm, said corrugated stator comprising the operating surface of the stator and having a substantially similar curvature as the corrugated emitter diaphragm.

10. A transducer as defined in claim 9 wherein the corrugated stator is two corrugated stators on opposite sides of the corrugated diaphragm having a substantially similar curvature as the diaphragm.

11. A transducer as defined in claim 9 wherein the corrugated stator further comprises angled spacers to support the diaphragm and avoid distortion producing contact with the stators.

12. A transducer as defined in claim 1, wherein the stator member further comprises an insulation layer on the operating surface of the stator to reduce diaphragm impact and avoid distortion producing contact with the stators.

13. A transducer as defined in claim 12, wherein the layer of insulation is paper.

14. A transducer as defined in claim 1, wherein the stator member is a concave paper stator.

15. A transducer as defined in claim 1, wherein the stator member is a convex paper stator.

16. A transducer as defined in claim 1, wherein the stator member is formed in a shape selected from the group of shapes consisting of curved, circular, and semi-circular shapes.

17. A transducer as defined in claim 1 wherein the diaphragm comprises a sheet of paper and includes a layer of conductive material applied to at least one surface of the diaphragm to provide the electrical conductivity.

18. A transducer as defined in claim 17, wherein the layer of conductive material comprises a deposited layer of metal.

19. A transducer as defined in claim 17, wherein the layer of conductive material comprises conductive doping material contained in the sheet of paper.

20. A transducer as defined in claim 17, wherein the diaphragm comprises a second sheet of paper applied to the opposing side of the conductive material to provide a conductive sheet which is sandwiched between two sheets of paper.

21. A transducer as defined in claim 1, wherein the emitter diaphragm is configured with at least one increased stiffness orientation which provides a primary directional stiffness along the diaphragm and within the emitter section to provide support to maintain the emitter diaphragm in an operable condition in the absence of tension applied along the stiffness orientation.

22. A transducer as defined in claim 21, wherein the nonplanar cross-section of the diaphragm is configured with at least one added thickness to the diaphragm, running in the direction of increased thickness.

23. A transducer as in claim 21, wherein the nonplanar cross-section of the diaphragm is configured with varied compositions of reduced flexibility in strips on the diaphragm, running in the direction of increased stiffness.

24. A transducer as defined in claim 21, wherein the primary directional stiffness is developed by a non-planar configuration.

25. A transducer as defined in claim 24, wherein the non-planar configuration comprises corrugated channels formed into the emitter diaphragm which provide the primary directional stiffness.

26. A transducer as defined in claim 21, further including securing structure applied at the diaphragm with respect to the operating surface of the stator member to secure an intermediate cross-section of the diaphragm in fixed position with respect to the stator member to isolate at least two separate emitter sections of the diaphragm.

27. A transducer as defined in claim 26, wherein the conductive material comprises a layer of aluminum positioned on the operating surface of the stator member.

28. A transducer in accordance with claim 21, wherein the stator member comprises a sheet of paper having a thickness of less than approximately 0.125 inches.

29. A transducer in accordance with claim 21, wherein the stator member comprises a sheet of paper having a thickness of 0.02 inches.

30. A transducer in accordance with claim 21, wherein the stator member comprises a sheet of cardboard having a corrugated member and at least one planar side bonded to the corrugated member to provide sufficient stiffness to operate as a stator with respect to the emitter diaphragm, said planar side comprising the operating surface of the stator.

31. A transducer in accordance with claim 21, wherein the stator member comprises a sheet of cardboard having a corrugated member and at least one planar side bonded to the corrugated member to provide sufficient stiffness to operate as a stator with respect to the emitter diaphragm, said corrugated member comprising the operating surface of the stator.

32. A transducer as defined in claim 21, wherein the means for providing conductivity includes conductive doping material within the sheet of paper.

33. A transducer as defined in claim 21, wherein the means for providing conductivity includes conductive material disposed on a surface of the stator member, said conductive material being acoustically transparent to sound waves generated by the emitter diaphragm.

34. A transducer as defined in claim 1, wherein the corrugated channels of the emitter diaphragm conform in cross-sectional configuration with corresponding corrugated channels in the operating surface of the stator member, said emitter diaphragm being nested within the channels of the of the stator member.

35. A transducer as defined in claim 1, wherein surface areas of the respective at least two separate emitter sections of the diaphragm are different in size to provide different resonant frequencies.

36. A transducer as defined in claim 1, wherein the diaphragm has a random pattern of peaks and valleys.

37. A transducer as defined in claim 1, wherein the diaphragm is configured in a rectified sine wave configuration.

38. A transducer as defined in claim 1, wherein the diaphragm is configured in a sawtooth pattern of peaks and valleys.

39. A transducer as defined in claim 1, wherein the diaphragm is a plurality of diaphragms arranged adjacent to each other between the stators.

40. An electroacoustic transducer, including:

at least one stator member having an operating surface for positioning adjacent an emitter diaphragm, said at least one stator member being comprised of at least one stiff sheet of paper having perforations for acoustic transparency and including means for developing electrical conductivity to receive an applied voltage;

an emitter diaphragm suspended adjacent to and spaced a sufficient distance from the operating surface of the stator member to enable diaphragm oscillation in response to an applied signal voltage to permit diaphragm movement within at least one emitter section without incurring interfering contact with the operating surface of the stator member;

said diaphragm having a composition of paper having electrical conductivity sufficient to receive an acoustic signal voltage from a voltage source and to vibrate as an acoustic emitter with respect to forces applied at the stator member;

electrical contacts positioned on the stator member for coupling to a voltage source; and electrical contacts positioned on the emitter diaphragm for coupling to a separate voltage source.

* * * * *